US010018323B2

(12) United States Patent
Fedosik et al.

(10) Patent No.: US 10,018,323 B2
(45) Date of Patent: Jul. 10, 2018

(54) VEHICLE HEADLIGHT

(71) Applicant: DOCTER OPTICS SE, Neustadt an der Orla (DE)

(72) Inventors: Dmitry Fedosik, Lippstadt (DE); Wolfram Wintzer, Jena (DE); Jens Fischer, Schleiz (DE)

(73) Assignee: Docter Optics SE, Neustadt an der Oria (DE)

( * ) Notice: Subject to any disclaimer, the term of this patent is extended or adjusted under 35 U.S.C. 154(b) by 180 days.

(21) Appl. No.: 14/356,245

(22) PCT Filed: Sep. 27, 2012

(86) PCT No.: PCT/EP2012/004051
§ 371 (c)(1),
(2) Date: May 5, 2014

(87) PCT Pub. No.: WO2013/068063
PCT Pub. Date: May 16, 2013

(65) Prior Publication Data

US 2014/0286032 A1 Sep. 25, 2014

(30) Foreign Application Priority Data

Nov. 11, 2011 (DE) ..... 10 2011 118 270
Nov. 11, 2011 (DE) ..... 10 2011 118 271
Jul. 14, 2012 (DE) ..... 10 2012 013 841

(51) Int. Cl.
*F21V 9/00* (2015.01)
*F21S 8/10* (2006.01)

(52) U.S. Cl.
CPC ..... *F21S 48/1225* (2013.01); *F21S 48/115* (2013.01); *F21S 48/1159* (2013.01);
(Continued)

(58) Field of Classification Search
CPC .. F21S 48/115; F21S 48/1241; F21S 48/1291; F21S 48/1394; F21S 48/1225;
(Continued)

(56) References Cited

U.S. PATENT DOCUMENTS 5,257,168 A 10/1993 Davenport et al.
5,697,690 A 12/1997 Okuchi et al.
(Continued)

FOREIGN PATENT DOCUMENTS

DE 1165514 B 9/1964
DE 4121673 A1 1/1993
(Continued)

OTHER PUBLICATIONS

Takahashi, et al. "Laser Headlight" for Next Generation Automotive Lighting. ISAL 2011—Proceedings pp. 271-283.
(Continued)

*Primary Examiner* — Jason Moon Han
*Assistant Examiner* — Omar Rojas Cadima
(74) *Attorney, Agent, or Firm* — Barnes & Thornburg LLP

(57) ABSTRACT

The invention relates to a vehicle headlight having at least one light source arrangement comprising a laser, and having a headlight lens comprising a body composed of a transparent material, wherein the body comprises at least one light tunnel and a light-conducting part having at least one optically active light exit surface, wherein the light tunnel comprises at least one, more particularly optically active, light entrance surface and undergoes transition with a bend into the light-conducting part for the purpose of imaging the bend as a bright-dark boundary by means of light coupled or radiated from the light source arrangement into the light entrance surface.

18 Claims, 11 Drawing Sheets

(52) U.S. Cl.
CPC ..... *F21S 48/1241* (2013.01); *F21S 48/1291* (2013.01); *F21S 48/1394* (2013.01)

(58) Field of Classification Search
CPC .... F21S 48/1159; F21S 48/12; F21S 48/1715; G02B 3/00; G02B 3/0012; G02B 3/0037; G02B 3/0075; G02B 2003/0093; G02B 6/00; G02B 6/0001; G02B 6/0003; G02B 6/0005; G02B 6/0011; B60Q 1/04; B64D 47/04; F21W 2101/00
USPC ..... 362/511, 520, 509
See application file for complete search history.

(56) References Cited

U.S. PATENT DOCUMENTS

| | | | | |
|---|---|---|---|---|
| 6,709,141 | B1 | 3/2004 | Sisti | |
| 7,073,931 | B2 * | 7/2006 | Ishida | F21S 48/1154 257/E33.059 |
| 7,581,862 | B2 * | 9/2009 | Stefanov | F21S 48/1241 362/551 |
| 8,342,726 | B2 | 1/2013 | Fischer et al. | |
| 2004/0156209 | A1 | 8/2004 | Ishida | |
| 2005/0105301 | A1 | 5/2005 | Takeda et al. | |
| 2006/0087860 | A1 | 4/2006 | Ishida | |
| 2007/0147055 | A1 | 6/2007 | Komatsu | |
| 2007/0189352 | A1 * | 8/2007 | Nagahama | A61B 1/0653 372/71 |
| 2007/0201241 | A1 | 8/2007 | Komatsu | |
| 2010/0033849 | A1 | 2/2010 | Seki et al. | |
| 2011/0148280 | A1 | 6/2011 | Kishimoto et al. | |

FOREIGN PATENT DOCUMENTS

| | | | |
|---|---|---|---|
| DE | 4209957 | A1 | 9/1993 |
| DE | 4320554 | A1 | 12/1993 |
| DE | 19526512 | A1 | 1/1996 |
| DE | 19742159 | A1 | 4/1998 |
| DE | 10315131 | A1 | 10/2004 |
| DE | 20320546 | U1 | 3/2005 |
| DE | 202004005936 | U1 | 3/2005 |
| DE | 20320546 | U1 | 4/2005 |
| DE | 202004005936 | U1 | 4/2005 |
| DE | 102005009556 | A1 | 9/2005 |
| DE | 102005009556 | U1 | 9/2005 |
| DE | 102004043706 | A1 | 4/2006 |
| DE | 102004048500 | A1 | 4/2006 |
| DE | 1020050011760 | A1 | 9/2006 |
| DE | 102004043706 | A1 | 1/2007 |
| DE | 102008026626 | A1 | 12/2009 |
| DE | 10252228 | B4 | 1/2010 |
| DE | 102008049168 | A1 | 4/2010 |
| DE | 102009008631 | A1 | 8/2010 |
| EP | 0493257 | | 7/1992 |
| EP | 1113216 | A2 | 7/2001 |
| EP | 1357333 | A2 | 10/2003 |
| EP | 1357334 | A1 | 10/2003 |
| EP | 1514148 | A1 | 3/2005 |
| EP | 1666787 | A1 | 6/2006 |
| EP | 1767398 | A1 | 3/2007 |
| EP | 1514148 | B1 | 1/2008 |
| EP | 2113222 | A1 | 11/2009 |
| EP | 2159479 | A2 | 3/2010 |
| EP | 2221219 | A1 | 8/2010 |
| FR | 2860280 | A1 | 9/2004 |
| GB | 2365962 | A | 2/2002 |
| GB | 2399622 | B | 8/2005 |
| GB | 2412159 | A | 9/2005 |
| JP | 2005317226 | | 11/2005 |
| JP | 2009-266437 | A | 11/2009 |
| WO | 20090109209 | A1 | 9/2009 |
| WO | 20090147070 | A1 | 12/2009 |

OTHER PUBLICATIONS

PCT International Search Report completed by the ISA/EP on Nov. 7, 2012 and issued in connection with PCT/EP2011/004051.
PCT International Search Report completed by the ISA/EP on Feb. 1, 2012 and issued in connection with PCT/EP2011/005698.
PCT International Search Report completed by the ISA/EP on Mar. 19, 2012 and issued in connection with PCT/EP2011/005699.
PCT International Search Report completed by the ISA/EP on Feb. 15, 2012 and issued in connection with PCT/EP2011/005700.
PCT International Search Report completed by the ISA/EP on Feb. 1, 2012 and issued in connection with PCT/EP2011/005701.
PCT International Search Report completed by the ISA/EP on May 9, 2012 and issued in connection with PCT/EP2011/005702.
PCT International Search Report completed by the ISA/EP on May 4, 2012 and issued in connection with PCT/EP2011/005703.
International Preliminary Report on Patentability (Chapter I) issued on Jun. 4, 2013 in connection with PCT/EP2011/005698.
International Preliminary Report on Patentability (Chapter I) issued on Jun. 4, 2013 in connection with PCT/EP2011/005699.
International Preliminary Report on Patentability (Chapter I) issued on Jun. 4, 2013 in connection with PCT/EP2011/005700.
International Preliminary Report on Patentability (Chapter I) issued on Jun. 4, 2013 in connection with PCT/EP2011/005701.
International Preliminary Report on Patentability (Chapter I) issued on Jun. 4, 2013 in connection with PCT/EP2011/005702.
International Preliminary Report on Patentability (Chapter I) issued on Jun. 4, 2013 in connection with PCT/EP2011/005703.
Cavouras, D., "Light emission efficiency and imaging performance of Y3Al5O12: Ce (YAG: Ce) powder screens under diagnostic radiology conditions", Applied Physics B 80, pp. 923-933 (2005).
Kvapil, Ji., et al. "Czochralski Growth of YAG: Ce in a Reducing Protective Atmosphere" Journal of Crystal Growth 52, pp. 542-545 (1981).
Choe, J. "Luminescence and compositional analysis of Y3Al5O12: Ce films fabricated by pulsed-laser deposition" Mat. Res. Innovat 6:238-241 (2002).
Zhou, Y,. et al. "Synthesis-dependent luminescence properties of Y3Al5O12:Re3+ (Re=Ce, Sm, Tb) phosphors" Elsevier, Materials Letters 56 (2002), pp. 628-636.
Del Rosario, G., et al. "Characterisation of YAG:Ce powders thermal treated at different temperatures" Applied Surface Science 238 (2004), pp. 469-474.
"Considerations for Encapsulant Material Selection for Phosphor-Converted LEDs" Application Notes from Intematix Product Information (Dec. 16, 2011).

* cited by examiner

VEHICLE HEADLIGHT

CROSS-REFERENCE TO RELATED APPLICATIONS

This is a U.S. National Stage Application of PCT/EP2012/004051 filed Sep. 27, 2012, the contents of which are hereby incorporated herein by reference.

FIELD OF THE INVENTION

The invention relates to a vehicle headlight including a headlight lens, which has a monolithic body of transparent material including at least one light entry face and at least one optically operative (also to be construed as 'effective') light exit face.

DE 203 20 546 U1 discloses a lens blank-molded on both sides and having a curved surface, a planar surface and a retention edge integrally molded on the lens edge, wherein a supporting or resting edge of a thickness of at least 0.2 mm and projecting with respect to the planar surface is integrally formed on the retention edge. Herein, the supporting edge is integrally formed on the outer circumference of the headlight lens. A further headlight lens having a supporting edge is disclosed e.g. by DE 10 2004 048 500 A1.

DE 20 2004 005 936 U1 discloses a lens for illuminating purposes, notably a lens for a headlight for imaging light emitted from a light source and reflected by a reflector for generating a predetermined illumination pattern, said lens having two opposing surfaces, wherein areas of different optical dispersion effects are provided on at least a first surface.

DE 103 15 131 A1 discloses a headlight for vehicles having at least one extensive luminous field including a plurality of illuminating element (diode)-chips and an optical element arranged in the light path of the light beam emitted by the luminous field, wherein the illuminating element chips of the luminous field are arranged in a common recess, and that the recess, on a side facing the direction of light emission, has an outer edge which, in relation to the elimination element chips, is spatially arranged such that a predetermined gradient of light density is formed in a light dispersion of the headlight in the area of the outer edges.

DE 10 2004 043 706 A1 discloses an optical system for a motor vehicle headlight for dispersing a beam of light rays from an illuminant, with an optical primary element having an optical face including a break or discontinuity extending along a line, being provided, wherein the optical face is configured to be smooth at least on one side adjacent the discontinuity so that the beam of light rays is separated into two partial beams of light rays. Herein, it is provided that at least one of the partial beams of light rays has a sharp edge of limitation. Moreover, the optical system comprises an optical secondary element for imaging the sharp edge of limitation onto a predetermined light (also known as "bright-")-dark-boundary.

EP 1 357 333 A2 discloses a light source device for a vehicle light which has an element emitting semiconductor light, which element is arranged on an optical axis of the light source device and emits its light essentially in an orthogonal direction with regard to the optical axis.

Further illumination of actions in context with vehicles are disclosed by DE 42 09 957 A1, DE 41 21 673 A1, DE 43 20 554 A1, DE 195 26 512 A1, DE 10 2009 008 631 A1, U.S. Pat. No. 5,257,168 and U.S. Pat. No. 5,697,690.

It is an object to suggest an improved headlight lens for a vehicle headlight, in particular for a motor vehicle headlight. It is a further object to reduce the costs for manufacturing vehicle headlights. It is a further object to reduce the costs for manufacturing vehicles. It is a still further object to suggest a vehicle having particularly compact dimmed headlight.

SUMMARY

The aforementioned object is achieved by a vehicle headlight, in particular a motor vehicle headlight, with at least one (first) light source arrangement comprising a laser, and with a headlight lens which comprises a particularly blank-molded, in particular monolithic (solid) body of transparent material, wherein the body comprises at least one light tunnel and one light passage section. The "light passage section" also termed "light conductive section" is a section in which incident light is guided or conducted to pass there through, including at least one optically operative light exit surface, wherein the light tunnel comprises at least one optically operative (first) light entry surface and, via a bend, passes over, transits or undergoes transition into the light passage/conductive section for imaging the bend as a light (bright)-dark-boundary by means of light from the first light source arrangement made to enter and irradiated into, respectively, the (first) light entry face.

A laser, e.g., a laser diode, may emit blue light. A laser comprises a system of semiconductor material of, for example, indium-gallium-nitride (InGaN).

An optically operative (effective) light entry face and an optically operative (effective) light exit face, respectively, is (constituted by) an optically operative surface of the body. An optically operative surface a surface of the transparent body, at which surface, when using the headlight lens according to its purpose light will be refracted. An optically operative surface is a surface at which, when using the headlight lens according to its purpose, the direction of light which passes through this surface will be changed.

Glass, e.g., inorganic glass material, is transparent. Transparent glass as described in document PCT/EP2008/010136 may be used in the following disclosed motor vehicle headlight and comprises 0.2 to 2% by weight $Al_2O_3$,
0.1 to 1% by weight $Li_2O$,
0.3 (in particular 0.4) to 1.5% by weight $Sb_2O_3$,
60 to 75% by weight $SiO_2$,
3 to 12% by weight $Na_2O$,
3 to 12% by weight $K_2O$, and
3 to 12% by weight CaO.

The term blank-molding is understood to mean that an optically operative surface is molded under pressure such that any subsequent finishing or post-treatment of the contour of this optically operative surface may be dispensed with and does not apply and will not have to be provided for, respectively. Consequently, it is particularly provided for that, after blank-molding, a blank-molded surface is not ground, i.e. it need not be treated by grinding.

In a light tunnel total reflection occurs at its lateral (in particular upper, lower, right and/or left) surfaces, so that light entering the light entry face is guided through the tunnel thus it is used as a light guide. A light tunnel is a light guide or light conductor. Total reflection is to occur on the longitudinal surfaces of the light tunnel. The longitudinal surfaces of the light tunnel are adapted for total reflection. The total reflection is to occur at the surfaces of the light tunnel essentially oriented in the direction of the optical axis of the light tunnel. Surfaces of the light tunnel essentially oriented in the direction of the optical axis of the light tunnel are adapted for total reflection. A light tunnel advantageously tapers in the direction towards its light entry face. A light tunnel advantageously tapers in the direction towards its light entry face by at least 3°. A light tunnel advantageously tapers in the direction towards its light entry face by at least 3° with respect to its optical axis. A light tunnel advantageously tapers at least partially in the direction towards its light entry face. A light tunnel advantageously tapers at least partially in the direction towards its light entry face by at least 3°. A light tunnel advantageously tapers at least partially in the direction towards its light entry face by at least 3° with respect to its optical axis.

A bend is, in particular, a curved transition. A bend a curved transition having a radius of curvature of no less than 50 nm. It is provided for that the surface of the headlight lens has no break or discontinuity in the bend, but is rather in the shape of a curve or curvature. It is provided for that the surface of the headlight lens in the bend has a curvature with a radius of curvature of the curve in the bend of no less than 50 nm. In an advantageous embodiment the radius of curvature is no larger than 5 mm. In an expedient embodiment the radius of curvature is no more than 0.25 mm, in particular no more than 0.15 mm, advantageously no more than 0.1 mm. In a further advantageous embodiment of the invention, the radius of curvature of the curve in the bend is at least 0.05 mm. It is provided for that the surface of the headlight lens is blank-molded in the region of the bend.

In a further advantageous embodiment the light source arrangement comprises a luminescent layer (also to be understood as a "layer of luminescent material") for generating white light when irradiated with light emitted by the laser, which luminescent layer is arranged in the optical path between the laser and the light entry face. Details regarding luminescent layers may be taken from www.phosphor-technology.com/faq.htm, J. Y. Choe, Mat Res Innovat 6:238-241, 2002, (2002 Luminescence and compositional analysis of YAG_Ce films fabricated by pulsed-laser deposition.pdf), G. Del Rosario et al., Applied Surface Science 238, 469-474, 2004 (2004 Characterisation of YAG_Ce powders thermal treated at different temperatures.pdf), Y. Zhou et al., Materials Letters 56, 628-636, 2002, (2002 Synthesis-dependent luminescence properties of YAG_Ce phosphors.pdf), J. Kvapil et al., Journal of Crystal Growth 52, 542-545, 1981, (1981 Czochralski growth of YAK-Ce in a reducing protective atmosphere.pdf), D. Cavouras et al, Appl. Phys. B 80, 923-933, 2005, (2005 Light emission efficiency and imaging performance of YAG_Ce powder screens,pdf), Internatix Produktinformation: (Internatix-App-Note-Encapsulant-Selection.pdf). In a further advantageous embodiment, the luminescent material layer is arranged on the light entry face.

In a further advantageous embodiment a luminescent layer is arranged on the light entry face. In a further advantageous embodiment of the invention a semi-transparent mirroring layer for reflecting white light generated by the luminescent (material) layer, is arranged on the layer of luminescent material.

In a further advantageous embodiment the light source arrangement comprises a semi-transparent mirroring layer for reflecting white light generated by the luminescent layer, which semi-transparent mirroring layer is arranged in the optical path between the laser and the luminescent layer. In a further advantageous embodiment the semi-transparent mirroring layer is arranged on the layer of luminescent material. It may be provided for that the luminescent layer is irradiated by the light of two lasers. It may be provided for that the luminescent layer is irradiated with the light of (at least) three lasers.

A semi-transparent mirroring layer is transparent particularly for light emitted from the laser.

In one embodiment the light source arrangement comprises an elastic light fibre for conducting light emitted from the laser and arranged in the light path between the laser and the luminescent layer and between the laser and the semi-transparent mirroring layer, respectively.

In a further advantageous embodiment the (first) light source arrangement and the (first) light entry face are designed and associated with each other such that light of the (first) light source arrangement enters the (first) light entry face at a luminous flux density of at least 75 lm/mm$^2$.

In a further advantageous embodiment the light tunnel is arranged between the bend and the light entry face. In a further advantageous embodiment the light passage section is arranged between the bend and the light exit face. In particular, it is provided for that light, which enters the transparent body through the light entry face and enters the passage section from the light tunnel in the area of the bend will exit from the light exit face at an angle of between −20° and 20° with regard to the optical axis. In particular, it is provided for that light which enters the transparent body through the light entry face will exit from the light exit face at an angle of between −20° and 20° with regard to the optical axis. Light which enters the transparent body through the light entry face and enters the passage section from the light tunnel in the area of the bend, will exit from the light exit face essentially in parallel to the optical axis. Light which enters the transparent body through the light entry face will exit from the light exit face essentially in parallel to the optical axis.

In a further advantageous embodiment the bend includes an opening angle of at least 90°. In a further expedient embodiment the bend includes an opening angle of no more than 150°. In a further favourable embodiment the bend is arranged on a surface of the light passage section, which surface is facing the light entry face.

In a further advantageous embodiment the orthogonal of the light entry face is inclined with respect to the optical axis of the light passage section. In a further expedient embodiment the light entry face is inclined with respect to the optical axis of the light passage section at an angle of between 5° and 70°, in particular at an angle of between 20° and 50°.

In a further advantageous embodiment the light tunnel comprises a region on its surface which corresponds essentially to a part of the surface of an ellipsoid. In a further expedient embodiment the light tunnel comprises a region on its surface which corresponds essentially to at least 15% of the surface of an ellipsoid.

In a yet further advantageous embodiment the light tunnel comprises a region on its surface, for which region the following applies:

$$0.75\cdot a\cdot\sqrt{1-\frac{y^2}{b^2}-\frac{z^2}{c^2}}\le x\le 1.25\cdot a\cdot\sqrt{1-\frac{y^2}{b^2}-\frac{z^2}{c^2}}$$

$$0.75\cdot b\cdot\sqrt{1-\frac{x^2}{a^2}-\frac{z^2}{c^2}}\le y\le 1.25\cdot b\cdot\sqrt{1-\frac{x^2}{a^2}-\frac{z^2}{c^2}},$$

in which z is a coordinate in the direction (of the optical axis) of the light tunnel;

x is a coordinate orthogonal to the direction of the optical axis of the light tunnel;

y is a coordinate orthogonal to the direction of the optical axis of the light tunnel;

a is a number having a value greater than 0;

b is a number having a value greater than 0; and c is a number having a value greater than 0.

In a further advantageous embodiment a surface of the light passage section facing the light tunnel is curved at least in the region of the bend for transition into the light tunnel, the curvature being convex. In a further advantageous embodiment the bend is curved in its longitudinal extension. In a further advantageous embodiment the bend is curved, in its longitudinal extension, having a radius of curvature of between 5 mm and 100 mm. In a still further advantageous embodiment the bend is curved, in its longitudinal extension, according to a Petzval curvature (also termed Petzval surface).

In a further expedient embodiment the bend comprises, in its longitudinal extension, a curvature having a radius of curvature in the orientation of the optical axis of the light tunnel and/or of the light passage section. In a yet further preferred embodiment the radius of curvature is orientated opposite to the light exit face.

In a further advantageous embodiment the bend is curved in a first direction and in a second direction. In a further expedient embodiment the first direction is orthogonal to the second direction. In a still further advantageous embodiment the bend is curved with a first radius of curvature in a first direction and with a second radius of curvature in a second direction, wherein the second radius of curvature is positioned orthogonal to the first radius of curvature.

In a further advantageous embodiment a portion of the surface of the passage section facing the light tunnel is designed as a Petzval surface. In a yet further advantageous embodiment the surface of the light passage section and facing the light tunnel is designed as a Petzval surface, in a region in which it undergoes transition into the light tunnel.

In a further advantageous embodiment the length of the headlight lens, when viewed in the orientation of the optical axis of the light tunnel and/or the light passage section, amounts to no more than 7 cm.

In a yet further advantageous embodiment the headlight lens and the transparent body, respectively, has a further light exit face as well as a further light entry face. In a further expedient embodiment at least 20% of the light entering the light entry face and exiting through the light exit face will exit through the light exit face after having exited from the monolithic body through the further light exit face and having entered the monolithic body through the further light entry face. In a still further advantageous embodiment at least 10%, in particular at least 20% of the light entering the light entry face and exiting through the light exit face will exit through the light exit face without having exited from the monolithic body through the further light exit face and without having entered the monolithic body through the further light entry face. In a yet further expedient embodiment at least 75% of the light entering the light entry face and exiting through the light exit face will exit through the light exit face after having exited from the monolithic body through the further light exit face and having entered the monolithic body through the further light entry face. In a still further advantageous embodiment it is provided for that light which enters the transparent body through the light entry face and enters the passage section from the light tunnel in the region of the bend will either exit from the monolithic body from the further light exit face and enter the further light entry face of the monolithic body as well as it will exit from the monolithic body from the light exit face, or it will exit directly from the light exit face (without exiting from the monolithic body through the further light exit face and entering the further light entry face of the monolithic body).

In a further expedient embodiment the vehicle headlight has no secondary optic associated with the headlight lens. A secondary optic is an optic for aligning light which exits from the light exit face and from the last light exit face, respectively. A secondary optic is an optical element for aligning light and separated from and/or subordinated with regard to the headlight lens. A secondary optic is no cover or protection disc, respectively, but an optical element provided for aligning light. An example of a secondary optic is e.g. a secondary lens as has been disclosed in DE 10 2004 043 706 A1.

The bend which is imaged as light-dark-boundary lies in the lower region of the light tunnel.

In a further expedient embodiment, the vehicle headlight comprises at least one light source and spatially separated from the light source arrangement, for making light enter and irradiating it into, respectively, the light tunnel and/or immediately (i.e. without passing through the light tunnel) into the light passage section. It may be provided for that a light source comprises several partial light sources. In a further advantageous embodiment, the vehicle headlight comprises at least one light source spatially separated from the light source arrangement, for making light enter a surface of the light conductive passage section and facing the light tunnel. In a further expedient embodiment light is irradiated, by means of the light source, above and/or below the bright-dark-boundary.

In a further advantageous embodiment the light source includes a source for light for driving round corners (such light, in the following briefly termed "corner light"), which corner light source is arranged, in particular, to the left of the optical axis of the light tunnel and/or above the optical axis of the light tunnel and/or of the light tunnel (as such). In a further advantageous embodiment the corner light source is arranged between the (first) light entry face and the light conductive passage section. In a further advantageous embodiment the light source includes one further corner light source, which is arranged to the right of the optical axis of the light tunnel and/or above the optical axis of the light tunnel and/or of the light tunnel (as such). In a further advantageous embodiment the corner light source is arranged between the (first) light entry face and the light conductive passage section.

In a further advantageous embodiment the light source comprises at least one partial light source arranged above the light tunnel. In a further advantageous embodiment the light source comprises at least two partial light sources arranged above the light tunnel, particularly separated spatially from one another. In a further advantageous embodiment the light source comprises at least one partial light source arranged below the light tunnel. In a further advantageous embodiment the light source comprises at least two partial light sources arranged below the light tunnel, separated spatially from one another. In a further advantageous embodiment the partial light source or one or several of the light sources is/are arranged between the (first) light entry face and the light passage portion.

In an advantageous embodiment the light source, a corner light source and/or a partial light source include/s at least one LED or an array of LEDs. In an expedient embodiment the light source comprises at least one OLED or an array of OLEDs. For example, the light source may well be a plane luminous field. The light source may also include light element chips as have been disclosed by DE 103 15 131 A1. A light source may also be a laser. A suitable laser has been disclosed in ISAL 2011 Proceedings, page 271ff.

The aforementioned object is moreover achieved by a vehicle headlight—comprising one or several of the aforementioned features—, in particular a motor vehicle headlight, wherein the vehicle headlight includes a headlight lens—comprising one or several of the aforementioned features—, wherein the headlight lens includes a blank-molded, particularly monolithic body of transparent material including an optically operative first light entry face for making light enter a first light tunnel section; at least one, optically operative second light entry face for making light enter a second light tunnel section; and at least one optically operative light exit face, wherein the monolithic body comprises a light tunnel in(to) which the first light tunnel section and the second light tunnel section open out, wherein the light tunnel, via a bend, passes over/transits into a light passage section for imaging the bend as a bright-dark-boundary, and wherein the vehicle headlight comprises a first light source arrangement comprising a laser, for making light enter the first light entry face and a second light source arrangement comprising a laser for making light enter the second light entry face.

It may be provided for that a light entry face and/or a light exit face include/s a light dispersing structure. A light dispersing structure may, for example, be a structure as has been disclosed in DE 10 2005 009 556 A1 and in EP 1 514 148 A1 and EP 1 514 148 B1, respectively. It may be provided for that a light tunnel is coated. It may be provided for that a light tunnel is coated with a reflective coating or layer. It may be provided for that a mirror-like reflective coating is applied to a light tunnel.

The aforementioned object is achieved by a vehicle headlight, in particular a motor vehicle headlight, the vehicle headlight comprising:

a first light source comprising a laser;

at least one second light source arrangement comprising a laser;

a first headlight lens (associated with the first light source arrangement), which comprises a blank-molded monolithic body of transparent material, wherein the monolithic body comprises at least one light tunnel and one light passage section or 'light conductive section' having at least one optically operative light exit face, wherein the light tunnel comprises at least one optically operative light entry face and (in particular for implementing dimmed headlights), via a bend, passes over/transits/undergoes transition into the light passage section for imaging (mapping) the bend as a light (bright)-dark-boundary by means of light from the first light source arrangement made to enter (also to be construed as "coupled") and irradiated into, respectively, the light entry face of the first headlight lens; and at least one second headlight lens (associated with the second light source arrangement), which comprises a particularly blank-molded monolithic body of transparent material, wherein the monolithic body comprises at least one light tunnel and a light passage (conductive) section having at least one optically operative light exit face, wherein the light tunnel comprises at least one, particularly optically operative light entry face and (in particular for implementing dimmed headlights), via a bend, undergoes transition into the light passage section for imaging the bend as a light-dark-boundary by means of light from the second light source arrangement made to enter and irradiated into, respectively, the light entry face of the second headlight lens, wherein the second headlight lens comprises an optical axis which is inclined, with respect to an optical axis of the first headlight lens, expediently by at least 0.5°, in particular by at least 4°.

In a further expedient embodiment the optical axis of the first headlight lens extends in an (essentially) horizontal plane. In a yet further advantageous embodiment the optical axis of the second headlight lens extends in an (essentially) horizontal plane.

In a further advantageous embodiment the vehicle headlight comprises at least one third light source arrangement and one third headlight lens (associated with the third light source arrangement), which comprises a particularly blank-molded monolithic body of transparent material, wherein the monolithic body comprises at least one light tunnel and one light passage section having at least one optically operative light exit face, wherein the light tunnel comprises at least one, optically effective light entry face, and (in particular for implementing dimmed headlights), via a bend, transits into the light passage section for imaging the bend as a bright-dark-boundary by means of light from the third light source arrangement made to enter (coupled) and irradiated into, respectively, the light entry face of the third headlight lens, and wherein the third headlight lens comprises an optical axis which is inclined, with respect to the optical axis of the second headlight lens and/or with respect to the optical axis of the second headlight lens, advantageously by at least 0.5°, in particular by at least 4°. In a further expedient embodiment of the invention the optical axis of the third headlight lens extends in a (essentially) horizontal plane.

In a further advantageous embodiment the vehicle headlight comprises at least one fourth light source arrangement and one fourth headlight lens (associated with the fourth light source), which comprises a blank-molded monolithic body of transparent material, wherein the monolithic body comprises at least one light tunnel and one light passage section having at least one optically operative light exit face, wherein the light tunnel comprises at least one optically operative light entry face and, via a bend (in particular for implementing dimmed light), forms transition to the light passage section for imaging the bend as a light-dark-boundary by means of light from the fourth light source arrangement made to enter (coupled) or irradiated into, respectively, the light entry face of the fourth headlight lens, and wherein the fourth headlight lens comprises an optical axis which is inclined, with respect to the optical axis of the first headlight lens and/or with respect to the optical axis of the second headlight lens, advantageously by at least 0.5°, in particular by at least 4° and/or with respect to the optical axis of the third headlight lens, advantageously by at least 0.5°, in particular by at least 4°. In a further expedient embodiment of the invention the optical axis of the fourth headlight lens extends in a (essentially) horizontal plane.

A motor vehicle is a land vehicle for individual use in road traffic. Motor vehicles are not restricted to land vehicles including a combustion engine. A motor vehicle, in the sense, comprises, in particular, at least four wheels. A motor vehicle comprises a seat for a driver and at least one front passenger seat arranged alongside the driver's seat seen in the transversal direction of the motor vehicle. A motor vehicle comprises at least four seats. A motor vehicle is admitted for at least four persons.

Further advantages and details may be taken from the following description of the examples of embodiment. Herein, there is represented in:

DETAILED DESCRIPTION OF THE DRAWINGS

Figure 1:
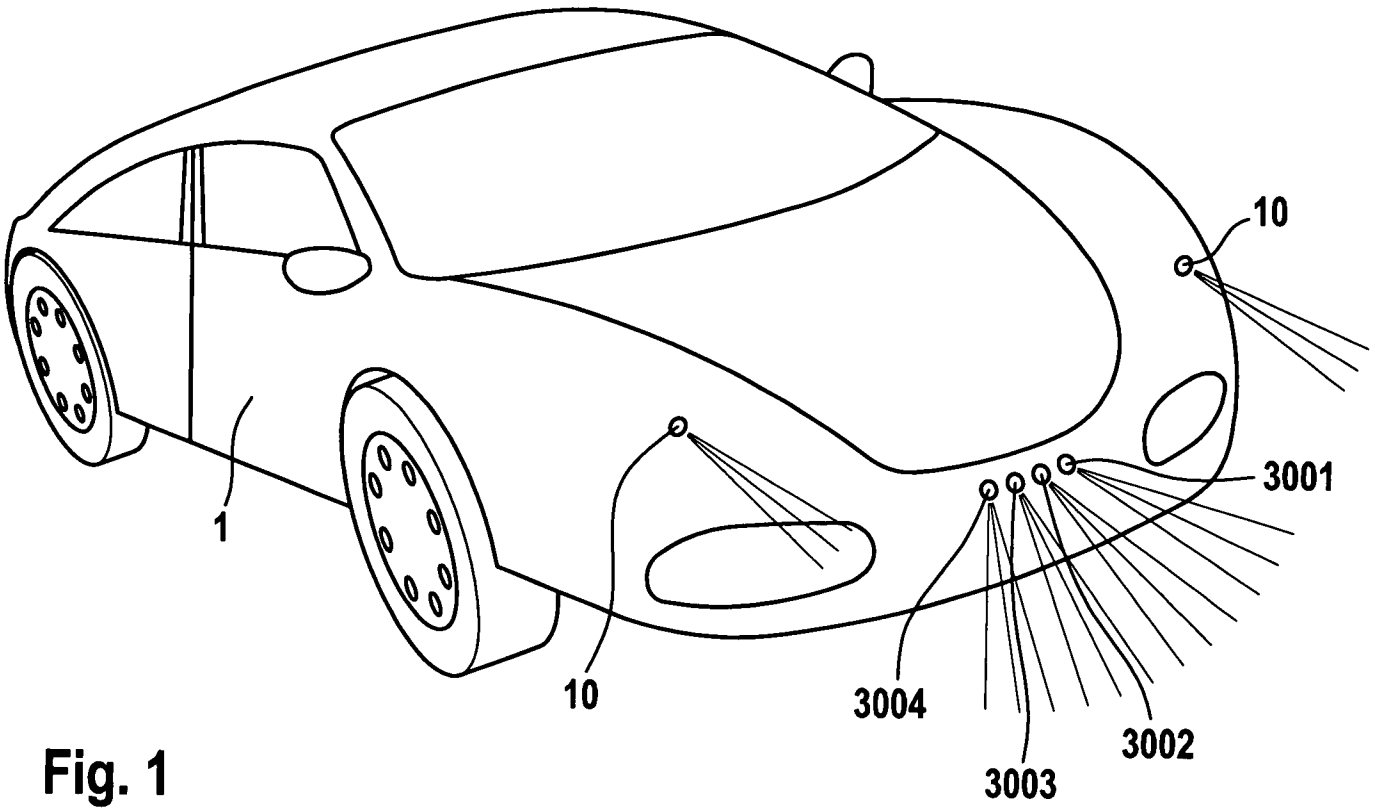
FIG. 1 an example of an embodiment of a motor vehicle.

FIG. 1 shows an example of embodiment of a motor vehicle 1 having motor vehicle headlights 10 and motor vehicle headlights/partial headlights 3001, 3002, 3003, and 3004, which are integrated in the body of the motor vehicle 1 within the central third of the front of the motor vehicle 1. The motor vehicle headlights 10 are, advantageously, integrated in the body of the motor vehicle 1 within the marginal area of the front of the motor vehicle 1.

Figure 2:
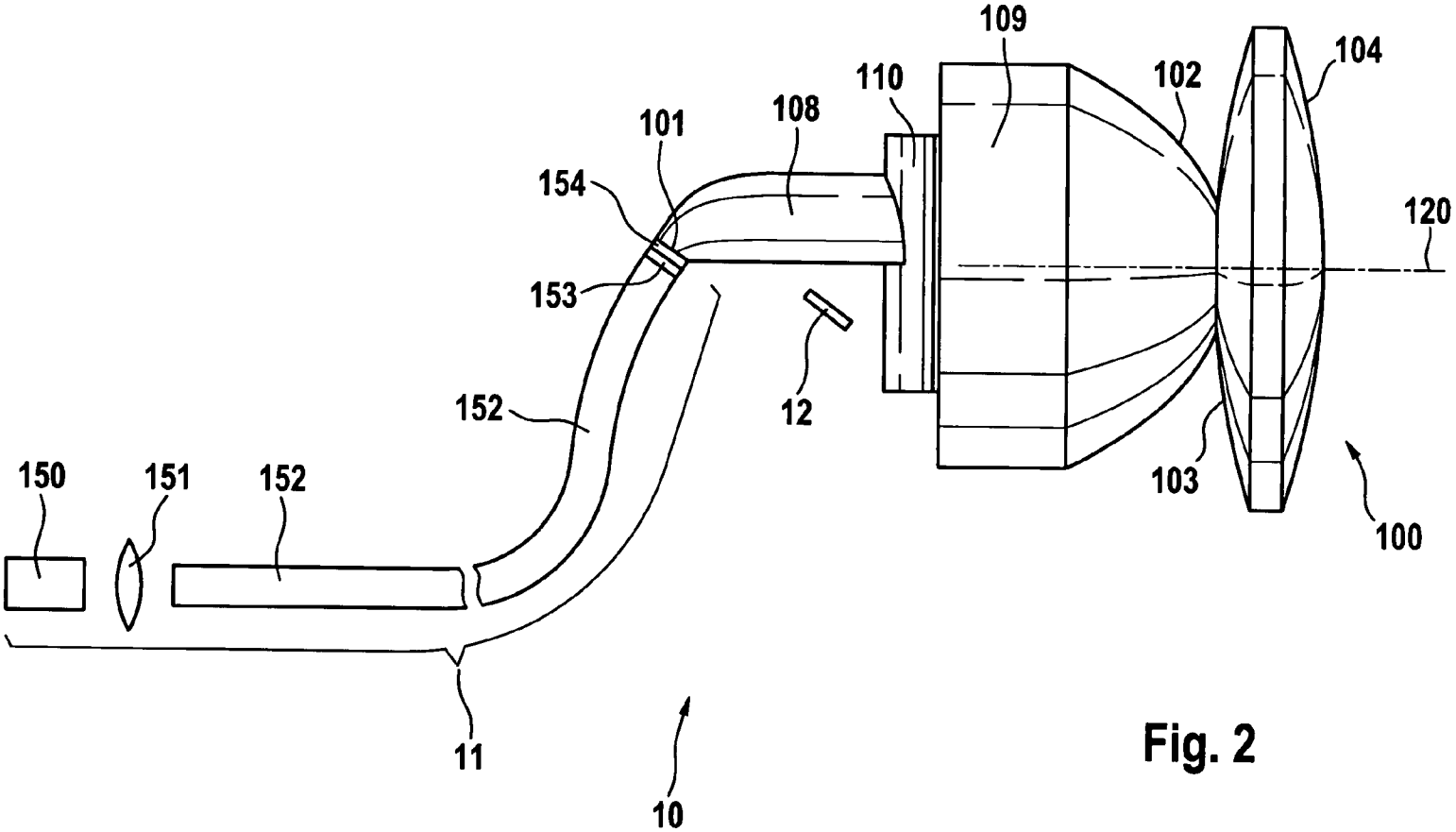
FIG. 2 an example of an embodiment of a headlight lens for use in the motor vehicle according to FIG. 1.
Figure 3:
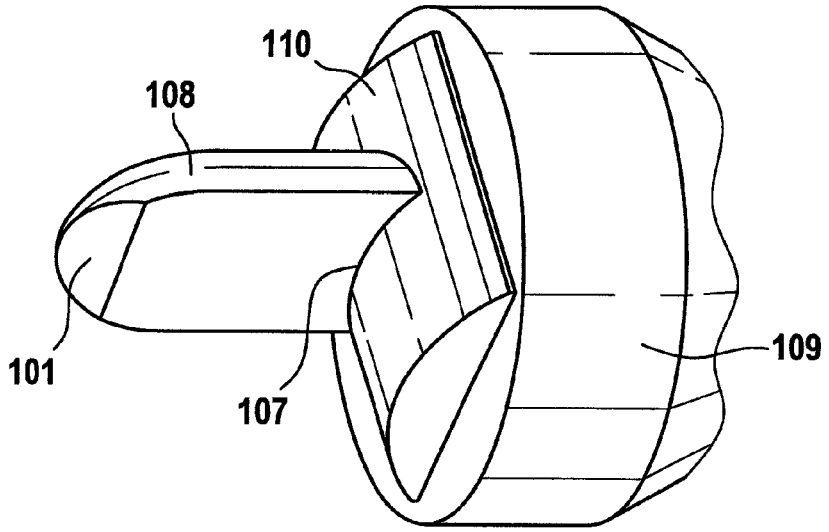
FIG. 3 a perspective view from below of a cut-out representation of a headlight lens of the motor vehicle headlight lens according to FIG. 2.

FIG. 2 shows the motor vehicle headlight 10 by way of a side view and having a headlight lens 100, but without a housing, fittings and energy supply, with the headlight lens 100 being represented in FIG. 3 in a cut-out manner by way of a perspective bottom view (view from below). The headlight lens 100 comprises a blank-molded monolithic body made from inorganic glass, in particular glass, which comprises 0.2 to 2% by weight $Al_2O_3$,
0.1 to 1% by weight $Li_2O$,
0.3, in particular 0.4 to 1.5% by weight $Sb_2O_3$,
60 to 75% by weight $SiO_2$,
3 to 12% by weight $Na_2O$,
3 to 12% by weight $K_2O$, and
3 to 12% by weight CaO.

The blank-molded monolithic body comprises a light tunnel 108, which, on its one side, has a light entry face 101 and, on another side, undergoes transition into a light passage (or conductive) section 109 (of the blank-molded monolithic body) via a bend 107 curved in two spatial directions, which section 109 has a light exit face 102, a light entry face 103 as well as a further light exit face 104. The headlight lens 100 is configured such that light entering the headlight lens 100 through the light entry face 101 and, in the region of the bend 107 entering the passage section from the light tunnel 108 will exit from the light exit face 104 essentially in parallel to the optical axis 120 of the headlight lens 100. Herein, the light passage section 109 images the bend 107 as a bright-dark-boundary. A portion of the surface of the light passage section 109 facing the light tunnel 108 is configured as a Petzval surface, said surface portion having been designated by reference numeral 110.

The motor vehicle headlight 10 has a light source arrangement or arrangement 11 comprising a laser 150 for emitting blue light and a light source 12 designed as an LED. The laser 150 is a laser diode whose semiconductor material system is formed from indium-gallium-nitride (InGaN). The light source arrangement 11 moreover comprises a luminescent (material) layer 154 for generating white light when irradiated by light emitted by the laser 150, which layer 154 is arranged on the light entry face 101 within the light path between the laser 150 and the light entry face 101, as well as a semi-transparent mirroring layer 153 for reflecting white light generated by the luminescent layer, with the mirroring layer 153 arranged within the light path between the laser 150 and the luminescent layer 154. By means of an optic 151 the light emitted by the laser 150 is made to enter a light conducting fibre 152 and, by means of the latter, is conducted onto the luminescent layer 154 and the semi-transparent mirroring layer 153, respectively, which is transparent for the light exiting from the light conductive fibre 152. Light generated by the luminescent layer 154 will be irradiated into and made to enter, respectively, the light entry face 101 of the light tunnel 108, for implementing dimmed light. By means of the light source 12, which may be switched-on alternatively for implementing sign light or drive light, light is introduced and irradiated, respectively, into a bottom side of the light tunnel 108 and into the portion 110, respectively, of the surface of the light passage section 109 facing the light tunnel 108, said portion 110 being configured as a Petzval surface.

Figure 4:
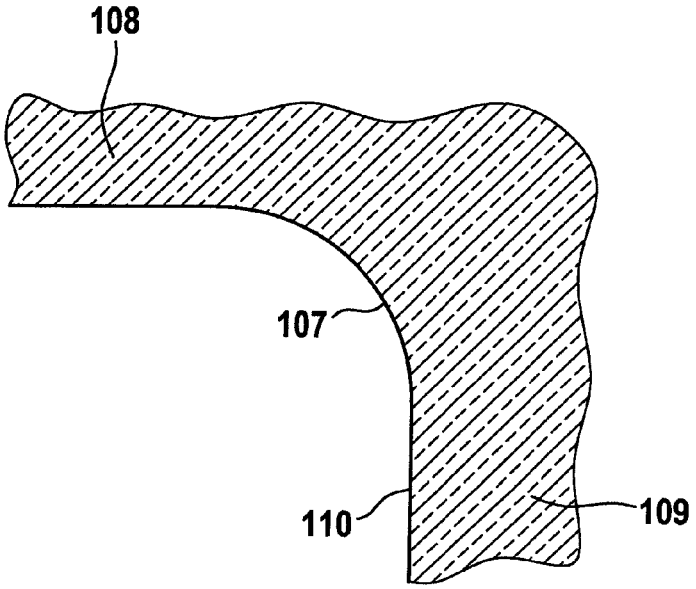
FIG. 4 an enlarged representation of a cut-out cross section of a bend for the transition of a light tunnel into a passage section of a headlight lens according to FIG. 3.

FIG. 4 shows, by way of an enlarged representation, a cut-out of the bend 107 for transition of the light tunnel 108 into the light passage section 109, the bend 107 being formed by blank-molding and configured as a continuous, curved transition having a radius of curvature of at least 0.15 mm.

Figure 5:
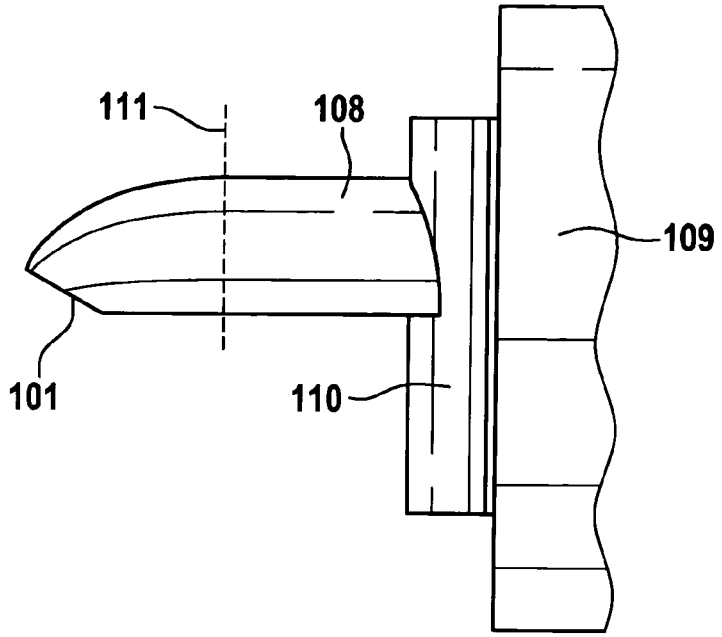
FIG. 5 a cut-out representation of a headlight lens according to FIG. 3 by way of a side view.
Figure 6:
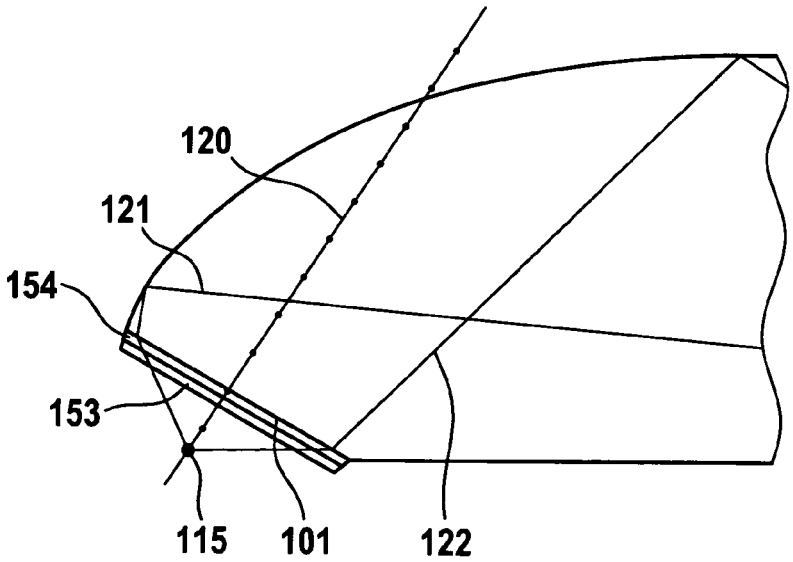
FIG. 6 a cut-out representation of a light tunnel of headlight lens of FIG. 3 by way of a side view.
Figure 7:
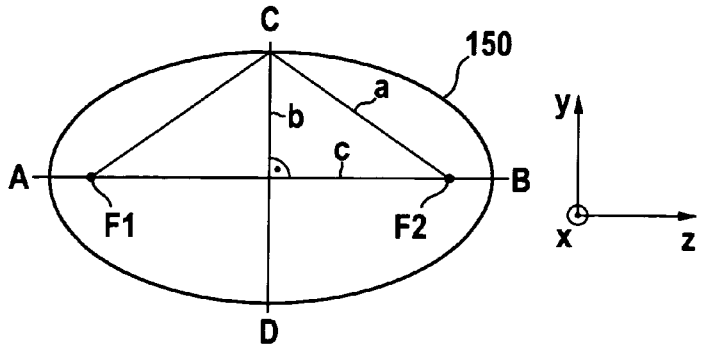
FIG. 7 an example of embodiment of an ellipsoid.
Figure 8:
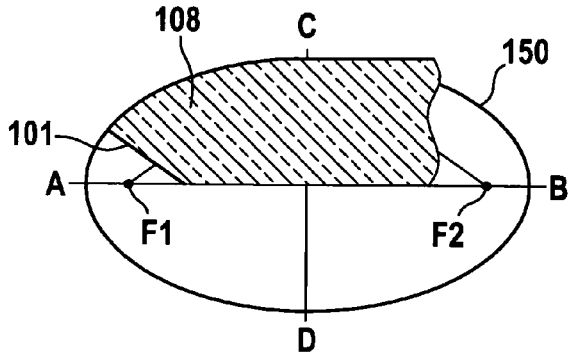
FIG. 8 a sectional representation of the ellipsoid according to FIG. 7 with a superimposed representation of a portion of the light tunnel represented in FIG. 6.

FIG. 5 shows a cut-out representation of a side view of the headlight lens 100. FIG. 6 shows an enlarged cut-out representation of a part of the light tunnel 108 up to the dotted line which has been designated by reference numeral 111 in FIG. 5. The upper portion of the part of the light tunnel as shown in FIG. 6 has been configured as an ellipsoid 150 as represented in FIG. 7. Herein, the dotted line 111 approximately corresponds to the axis C-D. For clarifying this configuration, a part of the cross section of light tunnel 108 in FIG. 8 is shown in a manner superimposing (overlaying) the representation of the ellipsoid 150. With regard to the ellipsoid 150 represented in FIG. 7 the following applies:

$$\frac{x^2}{a^2}+\frac{y^2}{b^2}+\frac{z^2}{c^2}-1=0$$

In this formula z is a coordinate in the direction of the optical axis of the light tunnel (A→B);

x is a coordinate orthogonal to the direction of the optical axis of the light tunnel; and y is a coordinate orthogonal to the direction of the optical axis of the light tunnel and to the x-direction (D→C).

a, b and, consequently, c have been selected such that all light beams or rays which pass through focus F1 will concentrate again in focus F2 after mirroring in the surface of the ellipsoid. The course of the beams of light from the light source 11, which is irradiated into or made to enter, respectively, the light entry face 101 is made clear and illustrated by the light beams 121 and 122 depicted in FIG. 6. Reference numeral 120 of FIG. 6 designates the orthogonal of the light entry face 101. The mutual point of intersection of the orthogonal 120 of the light entry face 101 with the light beams 121 and 122 has been designated by reference numeral 115. The position of this point of intersection 115 corresponds to focus F1 in FIG. 7 and FIG. 8.

Figure 9:
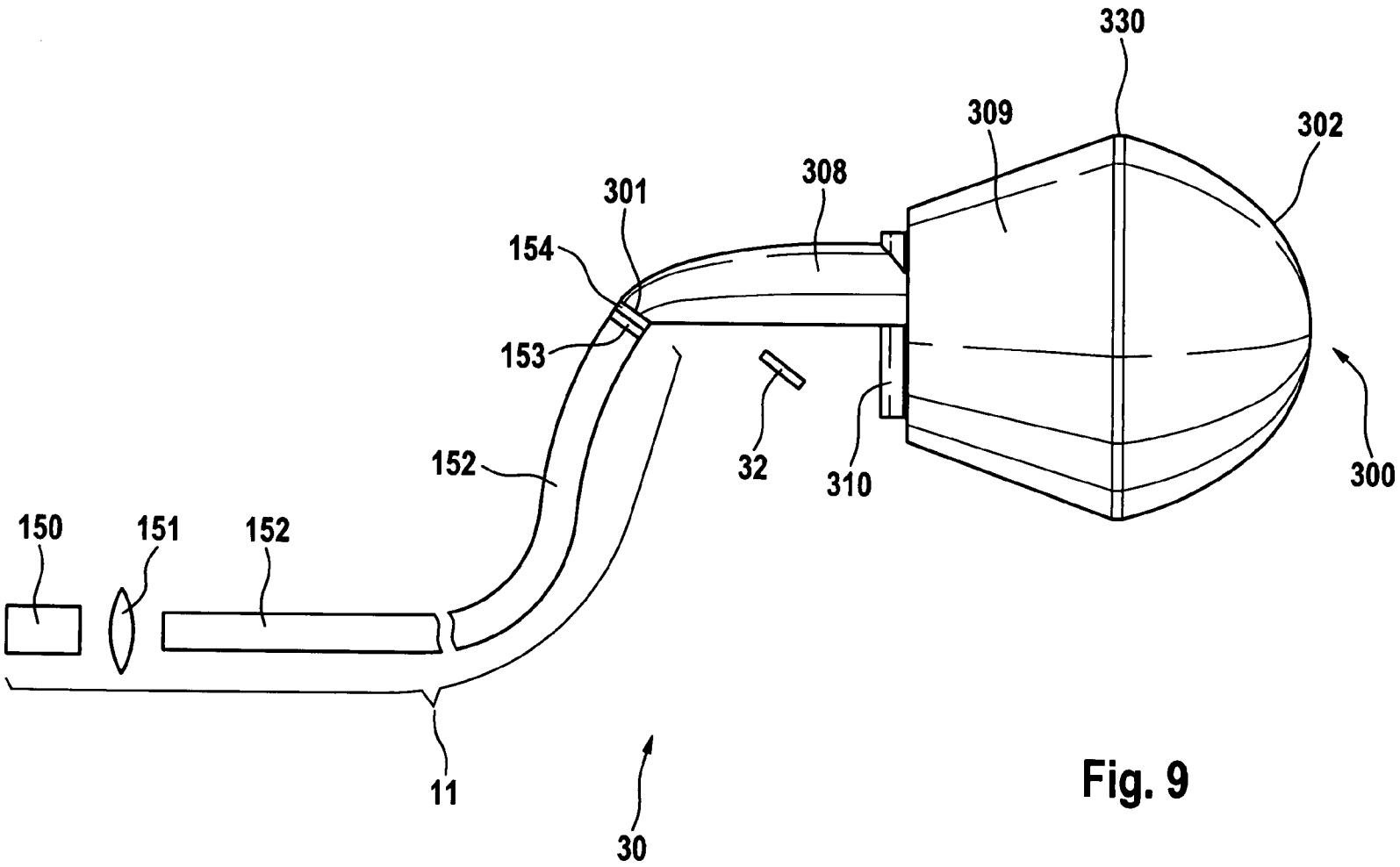
FIG. 9 a side view of a further alternative example of embodiment of a motor vehicle headlight (for use in the motor vehicle according to FIG. 1)
Figure 11:
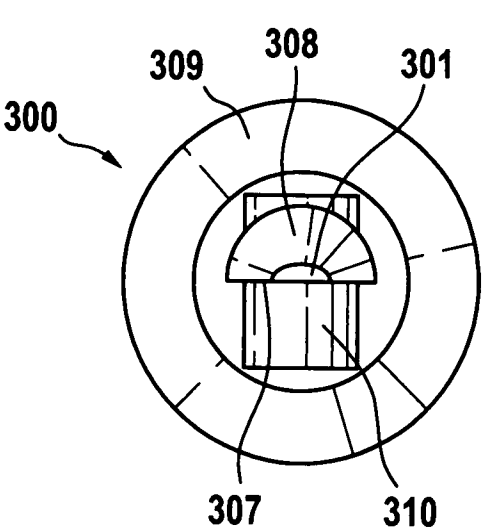
FIG. 11 the headlight lens according to FIG. 10 by way of a rear view.
Figure 10:
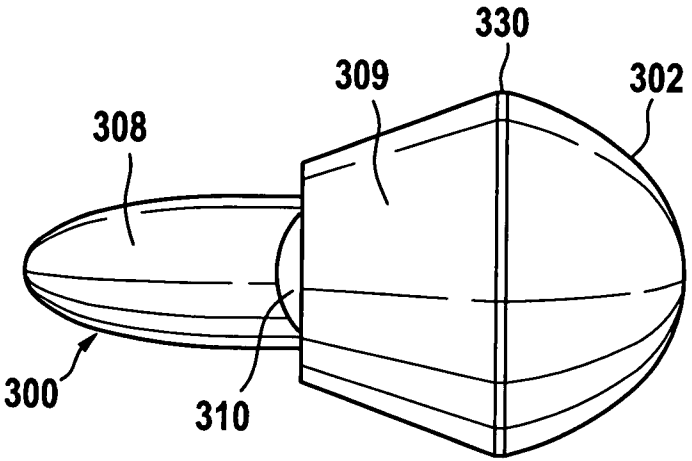
FIG. 10 an example of embodiment of a headlight lens of the motor vehicle headlight according to FIG. 9 by way of a top view.

FIG. 9 shows a further motor vehicle headlight 30 by way of a side elevation and to be used alternatively with regard to motor vehicle headlight 10. The motor vehicle headlight 30 comprises a headlight lens 300. FIG. 10 shows the headlight lens 300 by way of a top view, and FIG. 11 shows the headlight lens 300 from the rear. The headlight lens 300 comprises a blank-molded monolithic body made from inorganic glass, which body comprises a light tunnel 308, which has a light entry face 301 on one side and, on the other side, passes over into a light passage or conductive section 309 (of the blank-molded monolithic body) via a bend 307 curved in two spatial dimensions, which light passage section 309 includes a light exit face 302. The headlight lens 300 is configured such that light which enters the headlight lens 300 through the light entry face 301 and, from the light tunnel 308 enters the passage section in the region of the bend 307 will exit from the light exit face 302 essentially in parallel to the optical axis of the headlight lens 300. Herein, the light passage section 309 images the bend 307 as a light-dark-boundary. A portion of the surface of the light passage section 309 designated by reference numeral 310 and facing the light tunnel 308 is shaped as a Petzval face. A rim or edge, in particular a circumferential edge, may be provided on the section designated by reference numeral 330 of the surface of the passage section 309, by means of which edge the headlight lens 300 may be fixed in a particularly appropriate manner.

The vehicle headlight 30 includes a light source arrangement 11 designed as an LED, and, optionally, a light source 32 configured as an LED. By means of the light source arrangement 11, and for the purpose of implementing dimmed light, light is irradiated into and made to enter, respectively, the light entry face 301 of the light tunnel 308. By means of the selectively connectable light source 32 for implementing sign light or drive light, light is made to enter and is irradiated into, respectively, a bottom side of the light tunnel 308 and into the Petzval-surface-configured portion 310, respectively, of the surface of the light passage section 309 facing the light tunnel 308, respectively.

Figure 12:
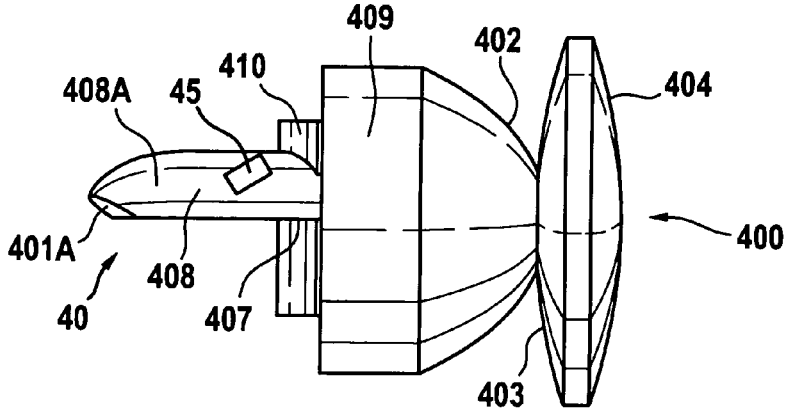
FIG. 12 a side view of a further alternative example of embodiment of a motor vehicle headlight (for use in the motor vehicle according to FIG. 1)
Figure 13:
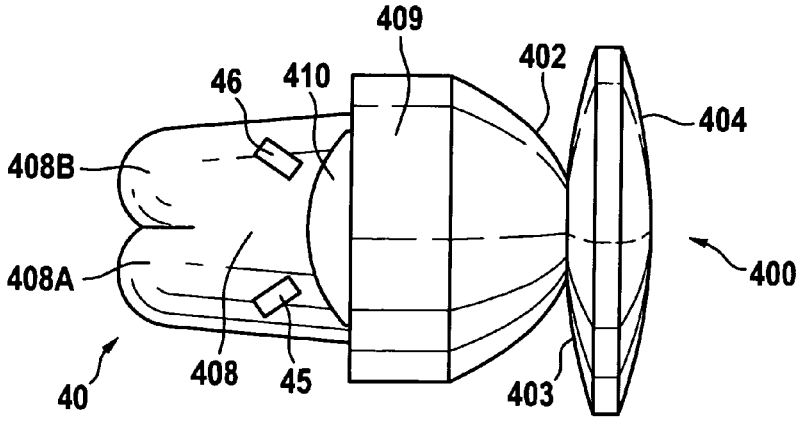
FIG. 13 the motor vehicle headlight according to FIG. 12 by way of a top view.
Figure 14:
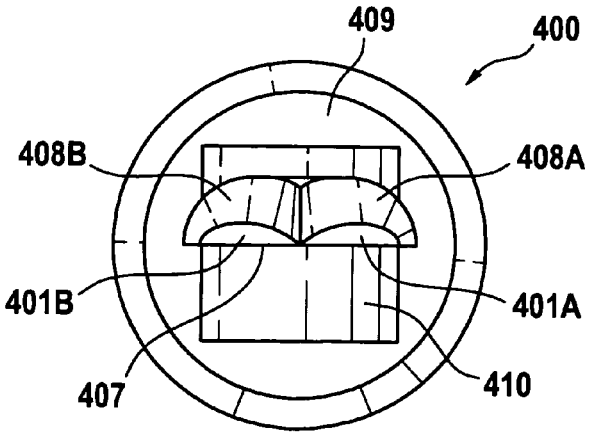
FIG. 14 a view from the rear of an example of embodiment of the headlight lens of the motor vehicle headlight according to FIG. 12.

FIG. 12 shows a further motor vehicle headlight 40 by way of a side elevation and to be used alternatively with regard to motor vehicle headlight 10. The motor vehicle headlight 40 comprises a headlight lens 400. FIG. 13 shows the motor vehicle headlight 40 by way of a top view, and FIG. 14 shows the headlight lens 400 from the rear. The headlight lens 400 comprises a blank-molded monolithic body made from inorganic glass, which body includes a light tunnel section 408A and a light tunnel section 408B, which open out in a light tunnel 408 which, in turn, undergoes transition to a light passage section 409 (of the blank-molded monolithic body) via a bend 407 curved in two spatial directions, which section 409 includes a light exit face 402, a light entry face 403, as well as a further light exit face 404. The light tunnel section 408A has a light entry face 401A, and the light tunnel section 408B has a light entry face 401B. The headlight lens 400 is configured such that light, which enters the headlight lens 400 through the light entry faces 401A and 401B and, in the region of the bend 407 enters the passage section from the light tunnel 408 will exit from the light exit face 404 essentially in parallel to the optical axis of the headlight lens 400. Herein, the light passage section 409 images the bend 407 as a bright-dark-boundary. A portion of the surface of the light passage section 409 designated by reference numeral 410 and facing the light tunnel 408 is configured as a Petzval surface.

Figure 15:
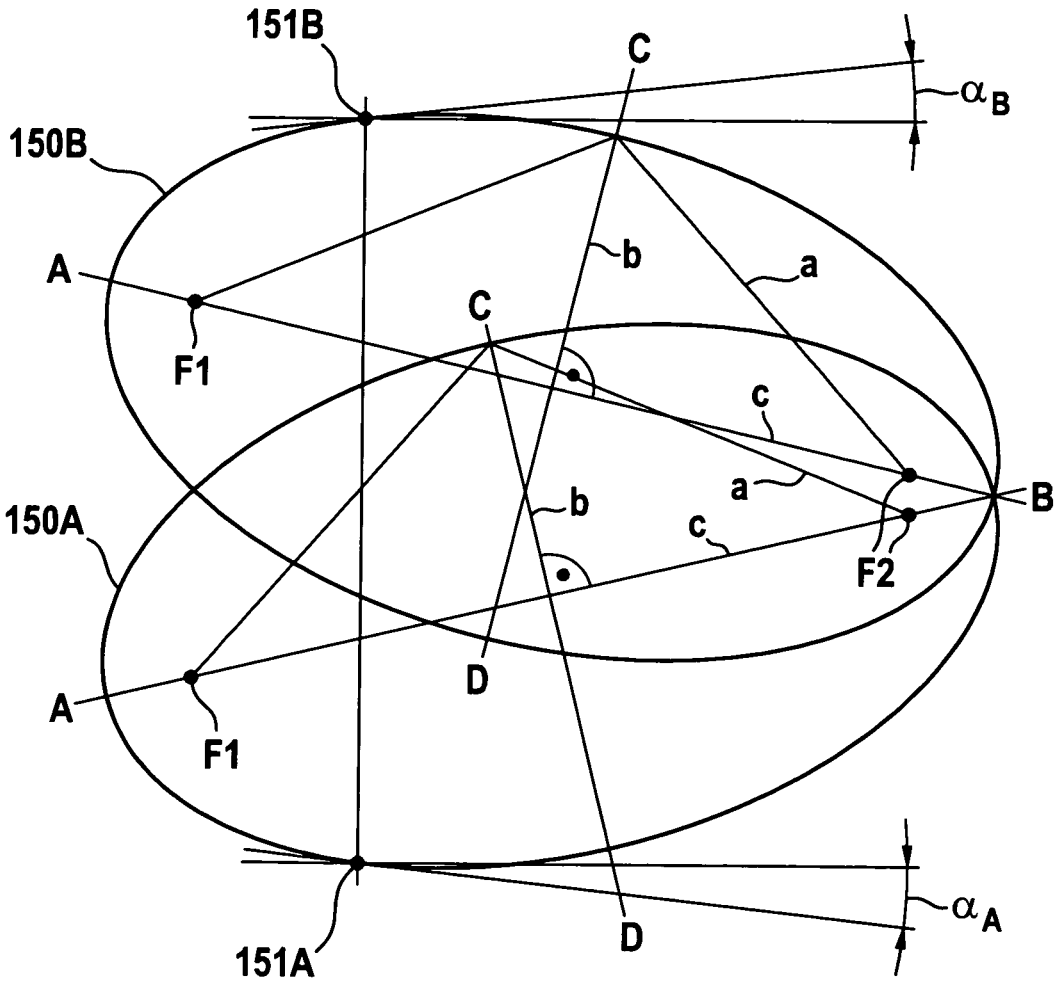
FIG. 15 a principle representation of an example of embodiment for the superimposition of two ellipsoids.

At least in their upper region, the light tunnel sections 408A and 408B are configured—taken in analogy to the explanations relating to FIG. 6—as part of an ellipsoid, as has been represented in principle in FIG. 15. Herein, reference numeral 150A designates an ellipsoid associated with the light tunnel section 408A, and reference numeral 150B designates an ellipsoid associated with the light tunnel section 408B. The ellipsoids 150A and 150B are, as has been represented in FIG. 15, aligned in relation to each other such that the respective focuses F2 will come to lie on top of each other. At the points designated by reference numerals 151A and 151B and starting at points 151A and 150B, respectively (in the direction of light propagation and towards the right, respectively), the surface contour of the headlight lens 400 deviates from the contour of an ellipsoid. Herein, the angles $\alpha_A$ and $\alpha_S$ indicate the directions of deviation with regard to the elliptic shape.

The motor vehicle headlight 40 includes two light sources, which, in analogy to light source 11 have been designed as LEDs and have not been depicted in FIG. 12 and FIG. 14 for the sake of clarity. By means of one of the light source arrangement, and for the purpose of implementing dimmed light, light is irradiated into and made to enter, respectively, the light entry face 401A of the light tunnel section 408A, and by means of the other one of the light source arrangement and for the purpose of implementing the dimmed light, light is irradiated into and made to enter, respectively, the light entry face 401B of the light tunnel section 408B. In addition, a non-shown are light source may be provided which corresponds to light source 12 with respect to position and performance.

In addition, and for implementing a corner light and/or a front fog light (adverse weather lamp) light sources 45 and 46 configured as LEDs are provided for, with the light sources 45 and 46 being alternatively connectable for implementing the corner light. You Herein, a non-shown control means is provided for within the motor vehicle 4, by means of which control the light source 45 is switched on for the time of driving round a left corner, and light source 46 is switched on for the time of driving round a right corner. For implementing a front fog light, either light source 46 or both light sources 45 and 46 will be switched on.

Figure 16:
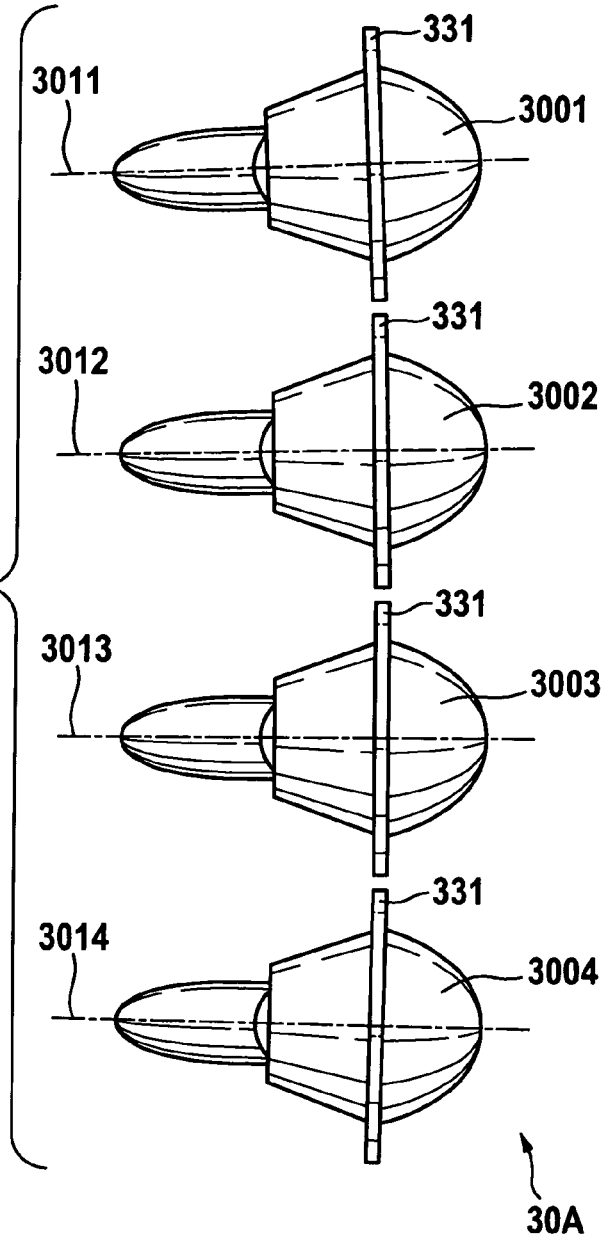
FIG. 16 a top view of an example of embodiment of a motor vehicle headlight lens arrangement for use in the motor vehicle according to FIG. 1.

FIG. 16 shows an example of embodiment of an alternatively applicable motor vehicle headlight arrangement 30A by way of a top view. The motor vehicle headlight arrangement 30A has partial headlights 3001, 3002, 3003, and 3004, which have headlight lenses designed in analogy to headlight lens 300, each, however, having a circumferential rim or edge 331 with differently configured bends, so that the bright-dark-boundary 3005 represented in FIG. 17 will be generated. The partial headlights 3001, 3002, 3003, and 3004, however, have a light source arrangement respectively configured analogous to light source arrangement 11.

Figure 17:
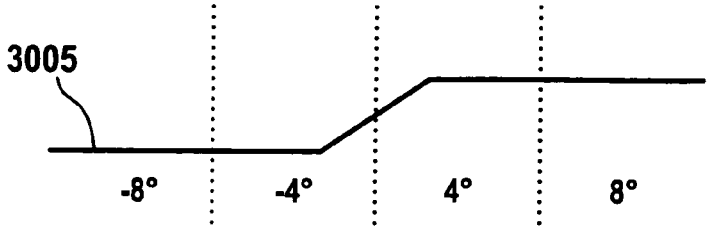
FIG. 17 a bright-dark-boundary generated by means of the motor vehicle headlight according to FIG. 16.

The optical axes 3011, 3012, 3013, and 3014 of the partial headlights 3001, 3002, 3003, and 3004, respectively, lie in a horizontal plane and are slightly inclined therein with respect to each other so that partial headlight 3001 illuminates essentially the −8° region, partial headlight 3002 illuminates essentially the −4° region, partial headlight 3003 illuminates essentially the 4° region and partial headlight 3004 illuminates essentially the 8° region, respectively, (cf. FIG. 17). It may be provided for that the partial headlights 3001, 3002, 3003, and 3004 are fixedly connected with each other within a module. It may be provided for that the partial headlights 3001, 3002, 3003, and 3004 are arranged in a mutual housing. It may also be provided for that the partial headlights 3001, 3002, 3003, and 3004 as well as further corresponding partial headlights are arranged along the circumference of a geometrical figure, in particular along a circle.

Figure 18:
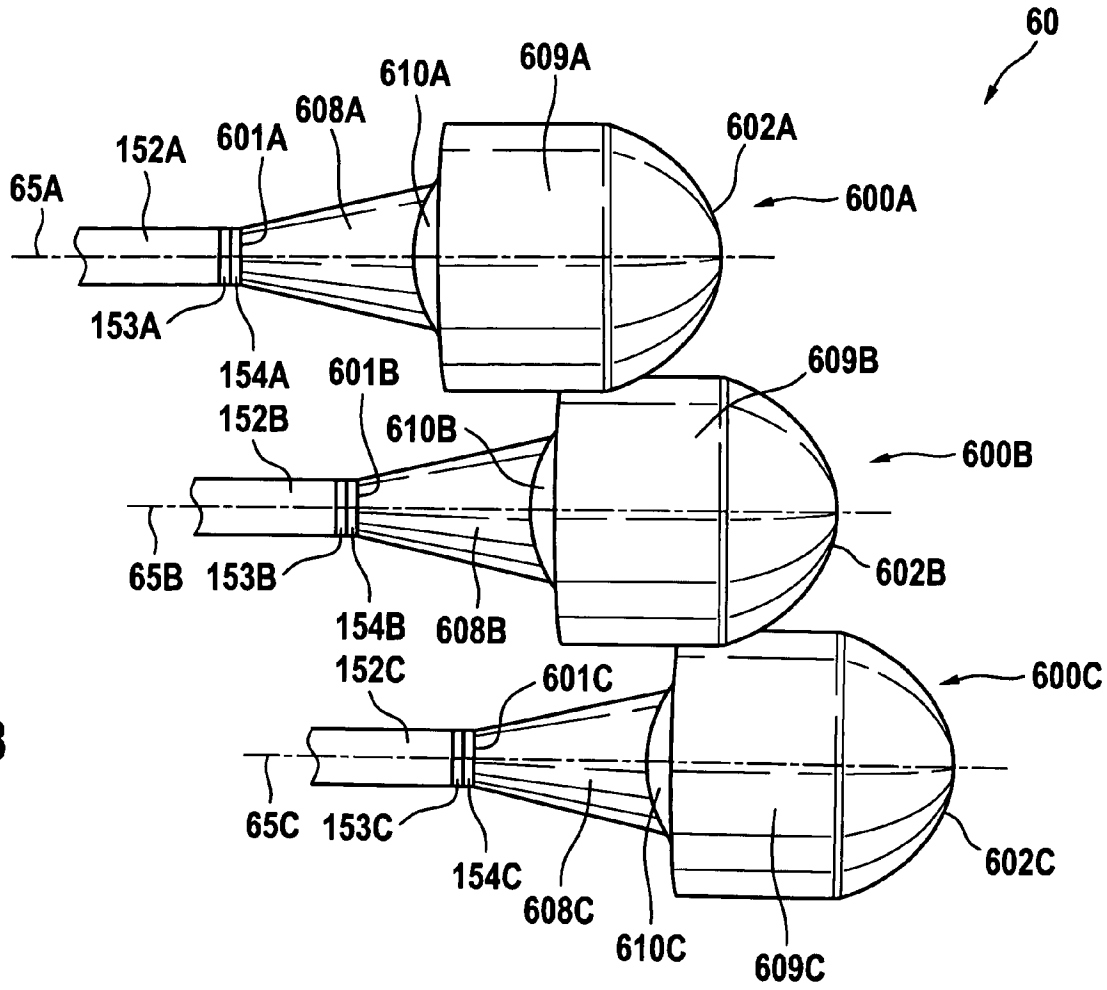
FIG. 18 a top view of a further example of embodiment of a motor vehicle headlight for use in the motor vehicle according to FIG. 1.

FIG. 18 shows, by way of a top view, a further motor vehicle headlight 60 alternatively to be used instead of motor vehicle headlight 10. The motor vehicle headlight 60 comprises a blank-molded, in particular monolithic body of inorganic glass, which body comprises a headlight lens part 600A, a headlight lens part 600B, and a headlight lens part 600C.

The headlight lens part 600A comprises a light tunnel 608A, which has a light entry face 601A on one side and, on another side (on the bottom side of the headlight lens part 600A), undergoes transition into a light passage or conductive section 609A of the headlight lens part 600A via a bend curved in two spatial dimensions, which light conductive section 609A includes a light exit face 602A. The headlight lens part 600A is configured in such a way that light, which enters the headlight lens 600A through the light entry face 601A, and from the light tunnel 608A enters the passage section in the region of the bend, will exit from the light exit face 602A essentially in parallel to the optical axis 65A of the headlight lens part 600A. Herein, the light passage section 609A images the bend as a light-dark-boundary. A portion of the surface of the light passage section 609A, which portion is facing the light tunnel 608A and has been designated by reference numeral 610A, is designed as a Petzval face.

The motor vehicle headlight 60 includes a light source arrangement comprising a non-shown laser for emitting blue light. The light source arrangement moreover comprises a luminescent layer 154A for generating white light when irradiated by light emitted from the laser, which layer 154A is arranged on the light entry face 601A within the light path between the laser and the light entry face 601A, as well as a semi-transparent mirroring layer 153A for reflecting white light generated by the luminescent layer, with the mirroring layer 153A arranged within the light path between the laser and the luminescent layer 154A. By means of a non-represented optic the light emitted by the laser is made to enter a light conducting fibre 152A and, by means of the latter, is conducted onto the luminescent layer 154A and the semi-transparent mirroring layer 153A, respectively, the latter being transparent for the light exiting from the light conductive fibre 152A. Light generated by the luminescent layer 154A will be irradiated into and made to enter, respectively, the light entry face 601A of the light tunnel 608A, for implementing dimmed light.

The headlight lens part 600B comprises a light tunnel 608B, which has a light entry face 601B on one side and, on another side (on the bottom side of the headlight lens part 600B), undergoes transition into a light passage or conductive section 609B of the headlight lens part 600B via a bend curved in two spatial dimensions, wherein the light conductive section 609B includes a light exit face 602B. The headlight lens part 600B is configured such that light, which enters the headlight lens 600B through the light entry face 601B, and, in the region of the bend, from the light tunnel 608B enters the passage section will exit from the light exit face 602B essentially in parallel to the optical axis 65B of the headlight lens part 600B. Herein, the light passage section 609B images the bend as a bright-dark-boundary. A portion of the surface of the light passage section 609B, which portion is facing the light tunnel 608B and has been designated by reference numeral 610B, is configured as a Petzval surface.

The motor vehicle headlight 60 includes a light source arrangement comprising a non-shown laser for emitting blue light. The light source arrangement moreover comprises a luminescent layer 154B for generating white light when irradiated by the light emitted from the laser, which layer 154B is arranged on the light entry face 601B within the light path between the laser and the light entry face 601B, as well as a semi-transparent mirroring layer 153B for reflecting white light generated by the luminescent layer, with the mirroring layer 153B arranged within the light path between the laser and the luminescent layer 154B. By means of a non-represented optic, the light emitted by the laser is made to enter a light conducting fibre 152B and, by means of the latter, is conducted onto the luminescent layer 154B and the semi-transparent mirroring layer 153B, respectively, the latter being transparent for the light exiting from the light conductive fibre 152B. Light generated by the luminescent layer 154B will be irradiated into and made to enter, respectively, the light entry face 601B of the light tunnel 608B, for implementing dimmed light.

The headlight lens part 600C comprises a light tunnel 608C, which has a light entry face 601C on one side and, on another side (on the bottom side of the headlight lens part 600C), undergoes transition into a light passage or conductive section 609C of the headlight lens part 600C via a bend curved in two spatial dimensions, wherein the light conductive section 609C includes a light exit face 602C. The headlight lens part 600C is configured such that light, which enters the headlight lens 600C through the light entry face 601C, and, in the region of the bend, from the light tunnel 608C enters the passage section will exit from the light exit face 602C essentially in parallel to the optical axis 65C of the headlight lens part 600C. Herein, the light passage section 609C images the bend as a bright-dark-boundary. A portion of the surface of the light passage section 609C, which portion is facing the light tunnel 608C and has been designated by reference numeral 610C, is configured as a Petzval surface.

The motor vehicle headlight 60 includes a light source arrangement comprising a non-shown laser for emitting blue light. The light source arrangement moreover comprises a luminescent layer 154C for generating white light when irradiated by the light emitted from the laser, which layer 154C is arranged on the light entry face 601C within the light path between the laser and the light entry face 601C, as well as a semi-transparent mirroring layer 153C for reflecting white light generated by the luminescent layer, with the mirroring layer 153C arranged within the light path between the laser and the luminescent layer 154C. By means of a non-represented optic, the light emitted by the laser is made to enter a light conducting fibre 152C and, by means of the latter, is conducted onto the luminescent layer 154C and the semi-transparent mirroring layer 153C, respectively, which latter layer is transparent for light exiting from the light conductive fibre 152C. Light generated by the luminescent layer 154C will be irradiated into and made to enter, respectively, the light entry face 601C of the light tunnel 608C, for implementing dimmed light.

The optical axis 65A lies in a first plane which is essentially horizontal. The optical axis 65B lies in a second plane which is essentially horizontal. The optical axis 65C lies in a third plane which is essentially horizontal. The first plane, the second plane, and the third plane extend essentially in parallel to each other. The optical axis 65A, moreover, lies in a first vertical plane. The optical axis 65B, moreover, lies in a second vertical plane. The optical axis 65C, moreover, lies in a third vertical plane. The first vertical plane is inclined by 0.5° with respect to the second vertical plane. The first vertical plane is inclined by 1° with respect to the third vertical plane. The second vertical plane is inclined by 0.5° with respect to the third vertical plane.

The elements, distances and angles in the figures have been drawn in consideration of simplicity and clearness and not necessarily to scale. For example, the orders of magnitude of some elements, distances and angles have been exaggerated with respect to other elements, distances and angles in order to improve comprehension of the example of embodiment of the present invention.

The invention claimed is:

1. A vehicle headlight comprising:

at least one light source arrangement comprising a laser, and a headlight lens which comprises a body of transparent material, the body comprising:

at least one light tunnel comprising at least one light entry-face;

a light passage section including at least one optically operative light exit face, wherein the light tunnel, via a bend, undergoes transition into the light passage section being configured for imaging the bend as a bright-dark-boundary by means of light irradiated from the light source arrangement into the light entry face;

a luminescent layer for generating white light when irradiated with light emitted by the laser, which luminescent layer is arranged in the optical path between the laser and the light entry face; and a semi-transparent mirroring layer for reflecting white light generated by the luminescent layer, which semi-transparent mirroring layer is arranged in the optical path between the laser and the luminescent layer.

2. Vehicle headlight as claimed in claim 1 wherein the luminescent layer is arranged on the light entry face.

3. Vehicle headlight as claimed in claim 1, wherein the semi-transparent mirroring layer is arranged on the luminescent layer.

4. Vehicle headlight as claimed in claim 3, the light source arrangement further comprising:

an elastic optical fibre for conducting light emitted by the laser, which optical fibre is arranged in the optical path between the laser and the luminescent layer.

5. Vehicle headlight as claimed in claim 4, wherein the optical fibre is arranged in the optical path between the laser and the semi-transparent mirroring layer.

6. Vehicle headlight as claimed in claim 1, wherein light of the light source arrangement enters the light entry face at a luminous flux density of at least 75 $lm/mm^2$.

7. Vehicle headlight, the vehicle headlight, comprising:

at least one light source arrangement comprising a laser; and a headlight lens which comprises a body of glass, the body comprising a light passage section including at least one optically operative light exit face; and at least one light tunnel passing over into the light passage section via a bend having a radius of curvature of at least 0.05 mm, wherein the light tunnel comprises at least one light entry face, and wherein the light passage section is configured for imaging the bend as a bright-dark-boundary by means of light from the light source arrangement irradiated into the light entry face;

a luminescent layer for generating white light when irradiated with light emitted by the laser, which luminescent layer is arranged in the optical path between the laser and the light entry face; and a semi-transparent mirroring layer for reflecting white light generated by the luminescent layer, which semi-transparent mirroring layer is arranged in the optical path between the laser and the luminescent layer.

8. Vehicle headlight as claimed in claim 7, wherein the luminescent layer is arranged on the light entry face.

9. Vehicle headlight as claimed in claim 8, the light source arrangement further comprising:

an elastic optical fibre for conducting light emitted by the laser, which optical fibre is arranged in the optical path between the laser and the luminescent layer.

10. Vehicle headlight as claimed in claim 9, wherein the bend has a radius of curvature of no more than 5 mm.

11. Vehicle headlight as claimed in claim 7 wherein the semi-transparent mirroring layer is arranged on the luminescent layer.

12. Vehicle headlight as claimed in claim 11, the light source arrangement further comprising:

an elastic optical fibre for conducting light emitted by the laser, which optical fibre is arranged in the optical path between the laser and the luminescent layer.

13. Vehicle headlight as claimed in claim 12, wherein the optical fibre is arranged in the optical path between the laser and the semi-transparent mirroring layer.

14. Vehicle headlight, the vehicle headlight comprising:

a headlight lens which comprises a monolithic body of glass, the monolithic body comprising:

a light passage section including at least one optically operative light exit face molded under pressure without any subsequent post-treatment of its contour; and at least one light tunnel, wherein the light tunnel comprises at least one light entry face and, via a bend, undergoes transition into the light passage section for imaging the bend as a bright-dark-boundary by means of light irradiated into the light entry face; and a light source arrangement comprising:

a laser diode; and a luminescent layer for generating and irradiating white light into the light entry face when irradiated with light emitted by the laser diode, said luminescent layer being arranged on the light entry face;

an elastic optical fibre for conducting light emitted by the laser diode, which optical fibre is arranged in the optical path between the laser diode and the luminescent layer, and a semi-transparent mirroring layer for reflecting white light generated by the luminescent layer, which semi-transparent mirroring layer is arranged in the optical path between the laser diode and the luminescent layer.

15. Vehicle headlight as claimed in claim 14, wherein the semi-transparent mirroring layer is arranged on the luminescent layer.

16. Vehicle headlight as claimed in claim 14, wherein the optical fibre is arranged in the optical path between the laser diode and the semi-transparent mirroring layer.

17. Vehicle headlight as claimed in claim 14, the light of the light source arrangement enters the light entry face at a luminous flux density of at least 75 $lm/mm^2$.

18. Vehicle headlight as claimed in claim 14, the bend having a radius of curvature of between 0.25 mm and 0.05 mm.

* * * * *